US006527934B1

(12) United States Patent
Steward

(10) Patent No.: US 6,527,934 B1
(45) Date of Patent: Mar. 4, 2003

(54) METHOD FOR ELECTROLYTIC DEPOSITION OF COPPER

(75) Inventor: Michael A. Steward, Dublin, VA (US)

(73) Assignee: Galvan Industries, Inc., Harrisburg, NC (US)

( * ) Notice: Subject to any disclaimer, the term of this patent is extended or adjusted under 35 U.S.C. 154(b) by 0 days.

(21) Appl. No.: 09/703,113

(22) Filed: Oct. 31, 2000

(51) Int. Cl.[7] ..... C25D 21/18

(52) U.S. Cl. ..... 205/101; 205/151; 205/291; 205/292

(58) Field of Search ..... 205/99, 101, 291, 205/292, 151

(56) References Cited

U.S. PATENT DOCUMENTS

| | | | | |
|---|---|---|---|---|
| 3,884,782 A | * | 5/1975 | Pottman et al. | 204/108 |
| 4,189,356 A | | 2/1980 | Merony et al. | 204/25 |
| 4,324,623 A | | 4/1982 | Schaer | 204/15 |
| 5,100,517 A | * | 3/1992 | Starinshak et al. | 205/138 |
| 5,242,571 A | | 9/1993 | Sien et al. | 205/138 |
| 5,366,612 A | | 11/1994 | Clouser et al. | 205/73 |
| 5,458,746 A | | 10/1995 | Burgess et al. | 204/106 |
| 5,516,408 A | | 5/1996 | Peckham et al. | 205/580 |
| 5,516,414 A | | 5/1996 | Giafenheim et al. | 205/50 |
| 5,520,792 A | | 5/1996 | Burgess et al. | 205/74 |
| 5,582,737 A | | 12/1996 | Gula et al. | 210/673 |
| 5,670,033 A | | 9/1997 | Burgess et al. | 205/74 |
| 5,863,410 A | * | 1/1999 | Yates et al. | 205/585 |
| 5,919,674 A | | 7/1999 | Tunley | 435/168 |
| 5,976,341 A | | 11/1999 | Schumacher et al. | 205/101 |
| 5,997,712 A | | 12/1999 | Ting et al. | 205/101 |

OTHER PUBLICATIONS

Arthur Rose et al., The Condensed Chemical Dictionary, Reinhold Book Corp., New York, p. 490, 1968.*

* cited by examiner

*Primary Examiner*—Nam Nguyen
*Assistant Examiner*—William T. Leader
(74) *Attorney, Agent, or Firm*—Moore & Van Allen PLLC; Jennifer L. Skord; Michael G. Johnston

(57) ABSTRACT

A process is provided for electrolytically depositing copper onto a workpiece. The process includes the steps of providing a copper generation vessel and generating a copper plating solution from solid-state copper in the vessel. The plating solution so generated is continuously circulated between the copper generation vessel and a plating vessel. An insoluble, dimensionally stable anode is provided in the plating vessel in contact with the plating solution. The workpiece is immersed in the plating solution in the plating vessel in close proximity to the anode. Electric current is passed through the plating solution between the anode and the workpiece to be plated so that the workpiece acts as a cathode in an electrolytic circuit and copper ions are electrolytically deposited on the workpiece. The process ensures that the workpiece is positioned relative to the anode so that all surfaces to be plated are exposed to the anode surface.

8 Claims, 3 Drawing Sheets

METHOD FOR ELECTROLYTIC DEPOSITION OF COPPER

BACKGROUND

The present invention relates generally to a method and apparatus for the manufacture of copper plated articles and, more particularly, to a method and apparatus for the manufacture of copper plated articles using insoluble anodes.

Articles, particularly steel articles, are copper plated to prevent corrosion and to provide a durable electrical connection, if needed. The articles may be copper electroplated from cyanide-bearing copper plating solutions, or from an acid copper solution after preliminary plating with nickel or another material sufficiently noble to preclude a non-adherent immersion plating from forming. In copper electroplating, whether conducted from cyanide-bearing baths or acid copper plating baths, the article to be plated, the workpiece, is made the cathode in an electrical circuit. The electric current causes the copper ions in solution to be reduced onto the article. In traditional electroplating, this same current is employed to impel the electrochemical dissolution of copper material in the anode into the solution to replace the plated-out ions.

The close coupling of cathode reactions to anode reactions in traditional copper plating operations has chemical, economic, and geometric consequences. Specifically, anode efficiency never exactly matches cathode efficiency such that the concentration of dissolved copper does not remain controllable but inexorably grows, causing a need for continuously discarding a portion of the bath and diluting the remainder. Also, because the dissolution of the anode material is electrochemical in nature, any tramp contaminating metals in the anodes will go into solution along with the copper. Prevention requires the employment of expensive, high purity anodes. Further, because the copper anode material is the counter electrode and it is continually dissolving, it is difficult to place the anodes in the desirable position of very close proximity to the workpiece for minimum solution resistance and consequent energy efficiency in the process. Conventional copper electroplating dictates that heat exchangers or refrigeration be provided for removing the heat generated to maintain the process within acceptable limits.

One application for copper electroplating is in the manufacture of ground rods. Ground rods start out as round steel shafts and are encased within a copper skin. Ground rods are manufactured by such methods as casting copper around a steel core or electroplating copper onto the steel core. Due to the stringency of ground rod service requirements, and the need to comply with recognized ANSI (Specification C135.30-1998, (Specification 467) and NEMA (Specification GR-1 1998) standards, the copper skin must exhibit excellent adhesion to the steel substrate, freedom from porosity, and, for adequate service life, a minimum thickness in the range of 0.010 inches.

Ground rods are usually rack plated or continuously plated either end-to-end or side-by-side. Rack plating involves placing the rods on racks and attaching the rods to cathode contacts. The racks of ground rods are immersed in a copper sulfate solution in the plating tank for a predetermined time. If racked vertically, one end of the rods remains topmost and the other end bottommost. If racked horizontally, one portion of the circumference of the rod faces up while another portion faces down, and some rods are topmost in the tank and others bottommost. The result of either arrangement is that the rods become susceptible to many well known variables which cause inconsistent plating: "shelf roughness" on upward facing surfaces, "gas pitting" on downward facing surfaces, "burning" on bottommost rods or rod ends due to temperature stratification near the bottom of the plating tank, and improper cleaning on topmost rods or rod ends due to solution foaming or inconsistent solution levels in the process tanks. Further, the cathode contacts also leave "rack marks" (i.e., thin or non-existent plating) on the rods at the point of contact. Proper plating requires that each contact point on the rack be regularly maintained lest a current break occur. Copper metal deposition in rack plating operations is also uneven due to the fixed orientation of the product relative to the anode. Elliptical coatings result when the product's face to the anode is not changed. More metal is deposited on the face closest to the anode than on the face away from the anode. In order to meet the UL specification of 0.010 inches of copper metal at any one spot, rack plating operations must deposit more copper than required on the face of rods closest to the anode to obtain the minimum thickness on the face away from the anode.

Continuous plating in end-to-end orientation results in the same susceptibility to "shelf roughness" and "gas pitting" because the rod surfaces relative to the anode and cathode do not change during plating. Further, since the rods are lined up end-to-end, and a large number must be in the plating tank simultaneously to effect a given production rate and a given plating time, end-to-end plating requires exceptionally long, space consuming, installations. Continuous single or multi-strand lines also require expensive straightening and recoiling equipment.

For the foregoing reasons, there is a need for a copper plating process which separates the cathodic plating current loop from the copper plating solution regeneration so that plating and regeneration can be independently adjustable. Ideally, the new process will eliminate the need for expensive, high purity anodes. The anodes should allow close positioning of the articles to be plated. This design, along with high energy efficiency should also permit plating with no auxiliary cooling. Other problems associated with conventional plating techniques, including "shelf roughness", "gas pitting" and "burning" should be overcome. The result should be consistent plating thickness and freedom from rack marks. An apparatus for use in the new process should minimize capital cost and conserve space.

SUMMARY

Therefore it is an object of the present invention to provide a method an d apparatus for copper plating which separates the cathodic plating current loop from the copper plating solution regeneration.

Another object of the present invention is to provide a method an d apparatus for copper plating that allows close positioning of the anode and the workpiece to be plated which high energy efficiency require no auxiliary cooling.

A further object of the present invention is to provide a method an d apparatus for copper plating which yields plated workpiece with consistent plating thickness. According to the present invention, a process for electrolytically depositing copper onto a workpiece comprises the steps of providing a copper generation vessel and generating a copper plating solution from solid-state copper in the vessel. The plating solution so generated is continuously circulated between the copper generation vessel and the plating vessel. An insoluble, dimensionally stable anode is provided in the plating vessel in contact with the plating solution. The workpiece is immersed in the plating solution in the plating vessel in close proximity to the anode. Electric current is passed through the plating solution between the anode and the workpiece to be plated so that the workpiece acts as a cathode in an electrolytic circuit and copper ions are electrolytically deposited on the workpiece. The process ensures that the workpiece is positioned relative to the anode so that all surfaces to be plated are exposed to the anode surface. In one embodiment, positioning the workpiece relative to the anode surface includes rotating the workpiece relative to the anode, which may be a lead anode.

The present invention also contemplates a copper plated product produced in accordance with the method set forth in claim 1.

Also according to the present invention, there is provided a method of replenishing the plating solution with copper in a copper electroplating process. The method comprises the steps of providing a solid-state supply of copper, adding sulfuric acid and hydrogen peroxide for dissolving the copper supply to maintain a copper concentration of about 35 ounces per gallon to about 65 ounces per gallon in the plating solution; and returning the plating solution with increased copper concentration into the plating tank. A feature of the present invention is that the process allows the use of scrap copper as the copper supply.

BRIEF DESCRIPTION OF THE DRAWINGS

For a more complete understanding of the present invention, reference should now be had to the embodiments shown in the accompanying drawings and described below. In the drawings.

DESCRIPTION

Certain terminology is used herein for convenience only and is not to be taken as a limitation on the invention. For example, words such as "upper," "lower," "left," "right," "horizontal," "vertical," "upward," and "downward" merely describe the configuration shown in the Figures. Indeed, the components may be oriented in any direction and the terminology, therefore, should be understood as encompassing such variations unless specified otherwise.

Figure 1:
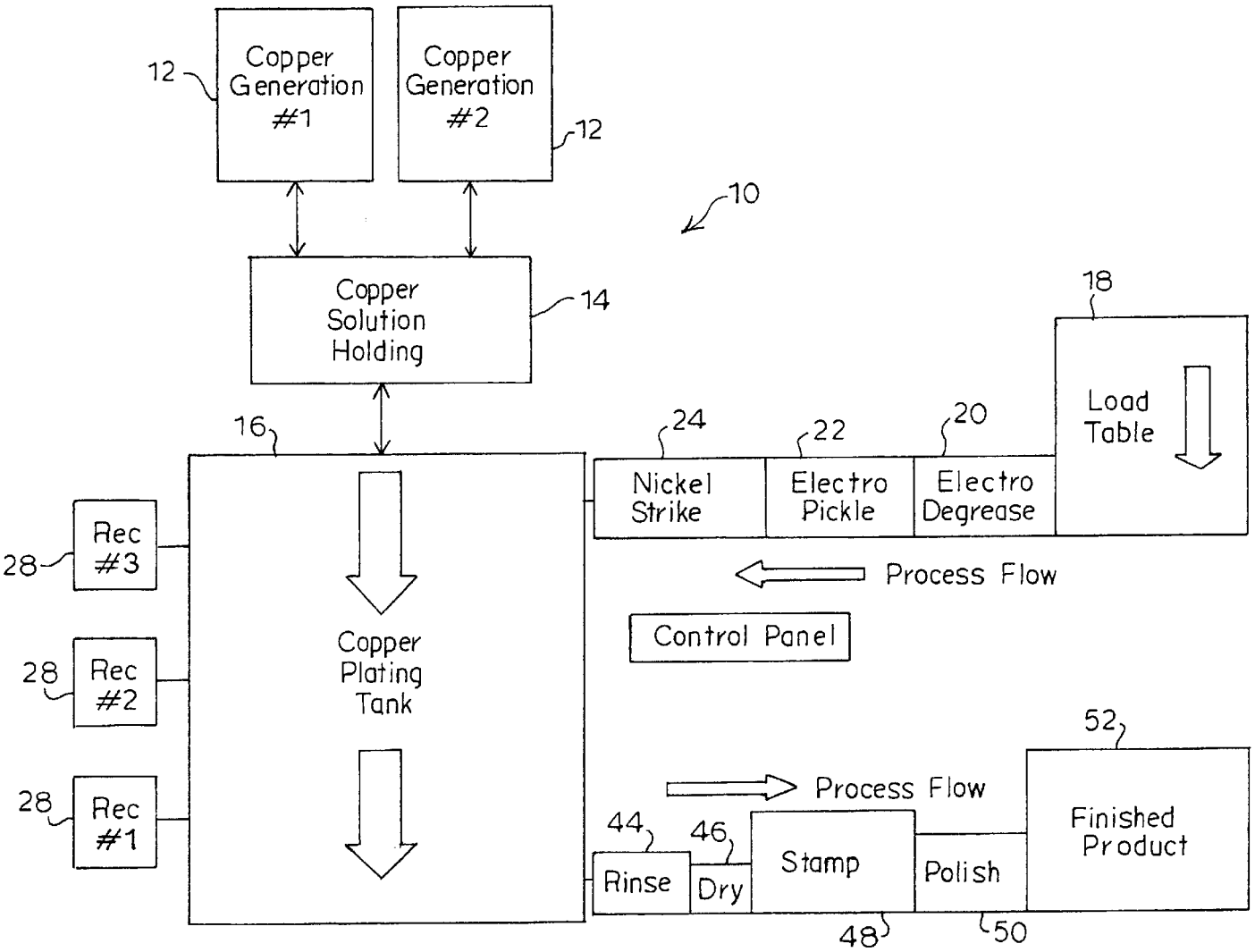
FIG. 1 is a flow diagram of a process for electrolytically depositing copper on a workpiece according to the present invention.
Figure 4:
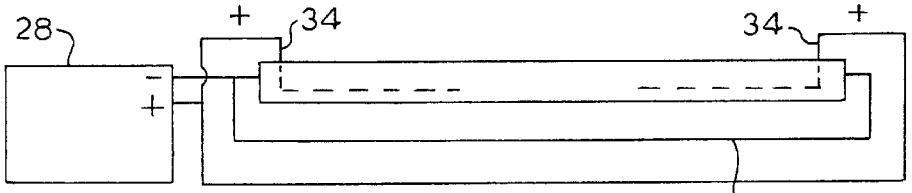
FIG. 4 is a schematic view of an electrolytic circuit for the electrolytic deposition of copper on a workpiece in the plating tank as shown in FIG. 2.

Referring now to the drawings, wherein like reference numerals designate corresponding or similar elements throughout the several views, a copper electroplating process according to the present invention is shown in FIG. 1 and generally designated at 10. Generally, the plating process includes generation of the copper plating solution, preparatory steel article cleaning, copper electroplating of the steel articles, and finishing, including polishing or anti-tarnish treatments.

The step of generating copper plating solution occurs in either of two copper generation tanks. According to the present invention, the copper plating solution generation begins with scrap copper. Any source of pure copper scrap or copper oxide may be used as long as the scrap copper is free of organic material. If necessary, the scrap copper is precleaned to remove organics and other contaminants. For example. #1 bare bright copper wire and #1 copper tubing are suitable. Sulfuric acid and hydrogen peroxide are added to the generation tanks to generate copper sulfate plating solution. The chemical reaction in the regeneration tank is as follows:

$$Cu+H_2SO_4+H_2O_2=CuSO4+2H_2O$$

A sulfuric acid concentration ranging from about 5% to about 20% is maintained in the generation tanks. A 50% solution of hydrogen peroxide is added to the regeneration tank by means of a metering pump so as not to exceed a concentration of about $4.5\times10^{-3}$ ounces/gallon in the plating tank. Higher levels of this oxidizing agent may not be dissipated by the operation and the residuals could interfere with the counter process of reduction which is required at the cathode, resulting in patchy electroplating or reduced energy efficiency. For a ground rod plating application, it has been found that acceptable plating can be obtained with a copper sulfate solution ranging in concentration from about 35 ounces/gallon to about 65 ounces/gallon.

The solution in the copper generation tanks 12 is continuously circulated through a holding tank 14 and then to a plating tank 16 where copper is deposited on the article, or work piece. Depleted copper plating solution returns from the plating tank 16 to the generation tanks 12 via the holding tank 14 in order to replenish the copper in the plating solution. The holding tank 14 acts as a buffer for the continuously circulating plating solution allowing the depleted plating tank solution and the copper generation plating solution to commingle. The plating solution flow rate from the generation tanks 12 is adjusted to correspond to the plating rates in the plating tank 16 so as to maintain a stable concentration of copper in the plating solution.

The step of cleaning of steel articles preparatory to copper electroplating is well known in the art and is achievable though mechanical, chemical or electrochemical methods. The steel articles must be completely free of contaminants that would interfere with the plating and subsequent adhesion of the nickel strike and copper plate. In the present example, hot rolled, cold drawn low to medium carbon steel rods are prepared for plating. The rods pass from a load table 18 through an electro-alkaline degrease 20 and an electro-sulfuric acid pickle 22 before entering the nickel strike 24. The product leaving the nickel strike 24 must be completely and uniformly plated with a thin nickel coating.

The step of copper electroplating of the steel articles may be conventional. A copper plating tank 16 is provided along with an appropriate number of rectifiers 28 for supplying the necessary electrical power. Because the source of the required copper ions is the chemical dissolution of in the afore-described generation tanks, copper anodes are not required in the plating tank, but insoluble anodes may be utilized. The insoluble anodes may be fabricated of any stable conductive metal compatible with the plating solution at issue. In the case of acid copper plating, such materials as platinum, platinized titanium, carbon, or lead or lead alloy anodes may be used. With insoluble anodes, the anode-cathode reaction in the plating tank involves the cathodic reduction of copper ions onto the workpiece, but does not involve anodic dissolution of copper.

Figure 2:
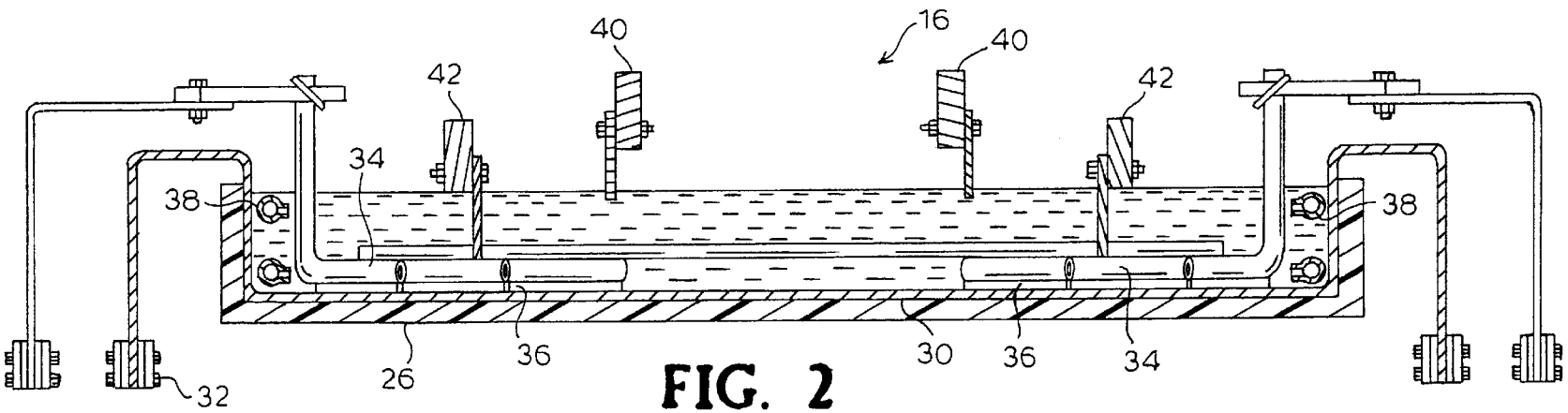
FIG. 2 is a cross section of a plating tank for use in the electrolytic deposition of copper on a workpiece according to the present invention.

A plating tank 16 incorporating an insoluble anode 30 for particular application in ground rod plating is shown in FIG. 2. The plating tank 16 is shallow and is only somewhat wider than the maximum length of the rods to be plated, which typically vary in length from about 4 feet to about 10 feet. The tank 16 is long enough to hold simultaneously a number of ground rods for the required plating time for plating the desired copper thickness while delivering the desired production rate. The tank 16 may be constructed of any of the many traditional materials suitable for acid copper electroplating processes, such as homopolymer polypropylene. The bottom 26 of the tank 16 is lined with the insoluble anode 30, in the present application lead. The lead lining 30 may cover the entire bottom 26 of the tank 16 or, in a preferred embodiment, lead strips 30 measuring about ¼" thick and about 12" wide are laid along the bottom 26 of the tank 16. The lead strips 30 lap over the sides of the tank and are connected to copper bus bars 32 that are connected to the anodic pole of the plating rectifiers 28.

A series of metallic conductors 34 are positioned along the bottom 26 of the tank 16 to serve as cathode contact rails. The size, shape, and material of the contact rails 34 are selected to be of a sufficient area to carry the required plating current. For plating ground rods, each cathode contact rail comprises a ⅛ inch by 1 inch stainless steel strip sandwiched between two ¾ inch square copper bars. The cathode contact rail assembly 34 is coated on all sides with an impervious and electrically insulative material, vinyl plastisol in the preferred embodiment, leaving the top edge of the stainless strip exposed along the length of the rail. This vinyl coating insulates the cathode contact rail 34 from the lead anode 30. Thin polypropylene strips 36, measuring about ½-inch wide by 9/16-inch tall, are welded to the tank bottom 26 and extend continuously across the width of the tank 16. The polypropylene strips 36 separate the lead sheets 30 and support the weight of the cathode contact rails 34 on the bottom 26 of the tank 16. The conductive rail material is extended up and out of the plating tank 16 and connected to the anodic pole of the rectifier via electrical cables or conventional bus bar.

Figure 3:
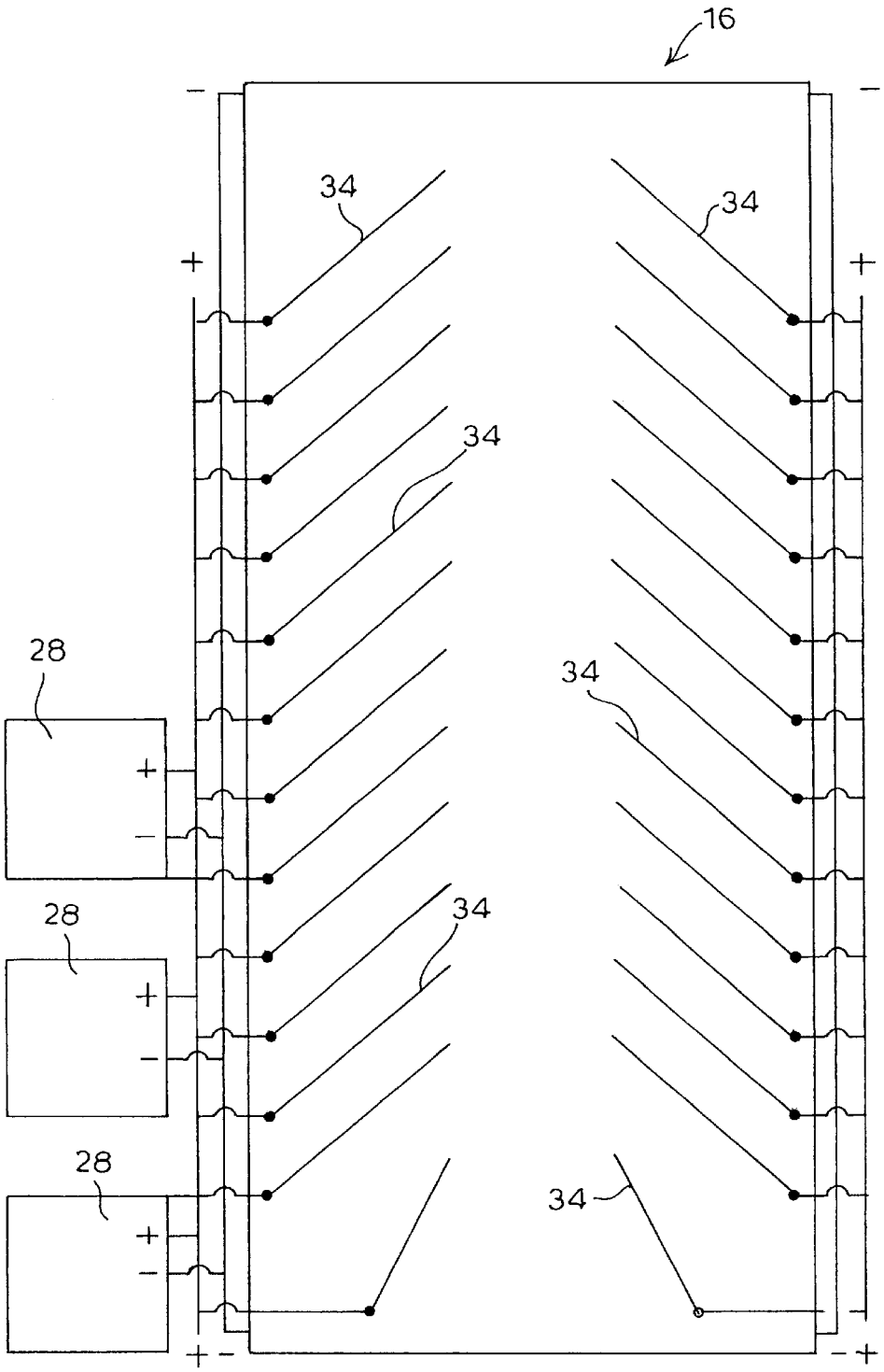
FIG. 3 is a top plan schematic view of the plating tank as shown in FIG. 2.

As seen in FIG. 3, the cathode contact rails 34 are positioned in the tank 16 so as to define a herringbone pattern. The cathode contact rails 34 support the rods to be plated while allowing the rods to advance by rolling along the bottom 26 of the plating tank 16, passing from one rail to the next without ever breaking contact by maintaining contact with at least one rail. The rods pick up the cathodic plating current from the contact rails. The rolling of the rods along the contact rails 34 exposes the entire surface of the ground rods to the anode 30 so that the plating thickness will be equal all around the circumference. Moreover, because the contact rails are arranged in a herringbone fashion, there are no tracks of thin plating, "rack marks", anywhere along the length of the rods.

The arrangement of the cathode contact rails 34 also facilitates high-pressure flow of copper plating solution from the holding tank 14. The plating solution supply lines 38 (FIG. 2) from the holding tank 14 are positioned so that jets of enriched copper sulfate solution are pumped between each of the cathode contact rails 34. The spacing of the cathode contact rails 34 allows the solution to flow along both sides of the rails where copper depletion from the solution is greatest. The solution is circulated around the rails 34 at sufficient flow rates that the quantity of copper which is reduced upon the workpieces by the cathodic current is more than replenished by fresh copper ions from the generation tank. It is well recognized that it is not possible for electroplating to proceed at a rate higher than the rate at which copper ions can be presented to the cathode surface. In turn, copper ions arrive at the cathode surface via diffusion from the solution in the vicinity of said surface, through the stagnant "boundary layer" known to fluid dynamics. The higher the copper concentration of the solution in the vicinity of the cathode surface and the thinner the boundary layer, the faster the diffusion and the plating rate. This invention focuses replenishment solution directly at the cathode surface to maximize copper concentration and provides turbulent flow to minimize the boundary layer. This allows plating current densities as high as 250 Amps/square foot in ground rod plating applications. Higher current density in the plating tank reduces the time required for the product to build up the required coating thickness which increases the production rate.

The ground rods may be advanced from an entrance end of the tank to an exit end by any means such as by gravity or other devices for propelling the ground rods. In the embodiment shown in FIG. 2, air-powered mechanical walking beams 40 paired with holding beams 42 are shown as one example. A set of comb-like plastic fixtures (not shown) depend downwardly from each beam 40, 42. The space between the teeth of the comb-like fixtures is sufficient for receiving a ground rod while maintaining a spacing of about 1-inch between rods. The beams 40, 42 are operated by a programmable controller which moves the beams up and down to roll the rods being plated from the entrance end of the tank 16 to the discharge end. The sequence is initiated when a ground rod exiting the nickel strike 24 trips a limit switch. The holding beam 42 drops down to engage the rods in the "teeth" to hold the rods stationary and maintain rod spacing. The walking beam 40 then moves horizontally one position toward the entrance end of the tank 16. The walking beam 40 then drops down to engage the rods. The holding beam 42 raises up to release the rods and the walking beam moves horizontally one position toward the exit end of the tank 16 thereby advancing all of the rods forward one position. A plated ground rod is removed from the exit end of the tank 16. This causes a vacancy at the entrance end of the tank 16, which is then filled with the next rod to be plated. The walking beam 40 then lifts up and the sequence starts again.

All electroplating processes are governed by Faraday's Law which states that one Faraday of electricity (96,500 ampere-seconds) will liberate one gram-equivalent weight of material at the cathode. The amount of copper deposited is thus directly proportional to the current flow. However, the voltage required in the electroplating process is proportional to the anode-to-cathode spacing. In the process and apparatus of the present invention, employing insoluble anodes and a unique mechanical design allows the ground rods, the cathodes, to lie less than an inch from the anode surface resulting in exceptionally low plating solution resistance. Ohm's Law states that the power required by the process is the product of the current and the voltage. In electroplating then, the power required and the waste heat generated are proportional to the solution resistance, which in turn is proportional to the anode-to-cathode spacing. Sufficiently close anode-to-cathode spacing in the process and apparatus of the present invention obviates the need for auxiliary heat exchangers.

Steps for finishing the copper-plated articles are well known, including simple polishing methods and chemical anti-tarnish treatments. In the ground rod application (FIG. 1), an automatic device picks each rod from the plating tank 16 when it reaches the last position and pushes it through rinse 44 and dry 46 stations. The dry rod is mechanically stamped 48 with a product identification number. After stamping, the rod is automatically fed into a polisher 50 and buffed with a buffing wheel. Upon exiting the polisher, the polished rod is sprayed with a brightener to maintain brightness of the finished product. The polished rod is then dropped into a machining center 52 that machines the appropriate point and chamfer on each end. Upon exiting the machining center 52 the rods are ready for packaging and shipment.

The process according to the present invention, decouples the anode-cathode process of electroplating from the process of regenerating the copper concentration of the plating solution thereby allowing the use of stable non-sacrificial anodes. The insoluble anode can be placed in consistently close proximity to the work surface being plated. This arrangement minimizes plating solution resistance and thus the plating power requirements. This feature of the invention, combined with the large heat losses inherent in high surface area tanks of the shape described, eliminates the need for auxiliary heat exchangers or refrigeration to remove waste heat. Thus, the process is highly energy efficient.

The use of an insoluble anode also solves the problem of the copper concentration in the solution relentlessly growing which eliminates the need to bleed off copper sulfate solution from the plating bath, saving the considerable costs of solution disposal and loss of copper. Copper sulfate is generated independently from the plating process allowing the operator to match the input of copper sulfate with its consumption in the plating bath. Moreover, because the copper concentration in the plating solution is replenished via chemical dissolution rather than electrochemical ionization, the dissolution process has a lowered propensity to dissolve non-copper materials, and permits the use of relatively low purity copper scrap rather than requiring expensive high-purity anode material as the source of the copper.

The present invention, as employed in the manufacture of ground rods, does not require expensive bath additives such as stress reducers, grain refiners, brighteners, addition agents, or other proprietary materials. Scrap copper of mediocre quality and acid and oxidizing agent to dissolve the copper are the only raw materials required for the copper plating step. The use of copper scrap reduces the raw material costs up to 30% relative to conventional copper plating. The side-by-side orientation of the ground rods allows for continuously plating in less space and equipment. Inherent in the current design is a rolling motion of the rods along a flat anode during plating which precludes "shelf roughness", "gas pitting", and uneven metal deposition.

It is understood that the process is advantageous in all acid copper plating processes, and especially in continuous processes such as wire and strip plating where close anode-to-cathode spacing can deliver the same benefits as in ground rod plating. It is also possible to configure the anode so that its shape follows the configuration of the product being plated. The size of the anode and its distance from the product could then be closely controlled providing similar efficiencies in other plating configurations such as in-line plating.

Although the present invention has been shown and described in considerable detail with respect to only a particular exemplary embodiment thereof, it should be understood by those skilled in the art that we do not intend to limit the invention to the embodiments since various modifications, omissions and additions may be made to the disclosed embodiments without materially departing from the novel teachings and advantages of the invention, particularly in light of the foregoing teachings. For example, any workpiece may be copper plated other than ground rods as long as consistent close proximity of the workpiece to the ground rod is maintained and all surfaces to be plated are exposed to the anode. Accordingly, we intend to cover all such modifications, omission, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a crew may be equivalent structures.

I claim:

1. A process for electrolytically depositing copper onto a workpiece utilizing an electroplating apparatus including a power source and a plating vessel, comprising the steps of:

providing a copper generation vessel;

generating a copper plating solution of $CuSO_4$ by adding solid-state copper and $H_2SO_4$ and $H_2O_2$ to the copper generation vessel;

continuously circulating the copper plating solution between the copper generation vessel and the plating vessel;

providing an insoluble, dimensionally stable anode in the plating vessel in contact with the plating solution;

immersing the workpiece in the plating solution in the plating vessel in close proximity to the anode;

passing an electric current through the plating solution between the anode and the workpiece to be plated so that the workpiece acts as a cathode in an electrolytic circuit and copper ions are electrolytically deposited as copper onto the workpiece;

positioning the workpiece in the plating solution in the plating vessel so that all surfaces to be plated are exposed to the anode surface; and maintaining the $H_2O_2$ at a concentration of about 0.0045 ounces per gallon or less in the plating solution in the plating vessel.

2. A process for electrolytically depositing copper onto a workpiece as recited in claim 1, wherein in the copper plating solution generation step, the solid-state copper comprises scrap copper.

3. A process for electrolytically depositing copper onto a workpiece as recited in claim 1, wherein the copper plating solution generation step comprises generating the copper plating solution while maintaining in the plating vessel a concentration of copper sulfate in the plating solution between about 35 ounces per gallon and about 65 ounces per gallon.

4. A process for electrolytically depositing copper onto a workpiece as recited in claim 1, wherein the circulation of plating solution between the copper generation vessel and the plating vessel is at a high pressure for agitating the plating solution in the plating vessel.

5. A process for electrolytically depositing copper onto a workpiece as recited in claim 1, wherein the step of providing an insoluble, dimensionally stable anode comprises providing an anode selected from the group consisting of a lead anode, a platinum anode, a platinized titanium anode, a carbon anode, and a lead alloy anode.

6. A process for electrolytically depositing copper onto a workpiece as recited in claim 1, wherein the step of positioning the workpiece comprises rotating the workpiece relative to the anode surface.

7. In a process for electroplating copper onto a workpiece wherein copper is electrolytically deposited from a copper plating solution in a plating tank, a method of replenishing the plating solution with copper sulfate, comprising the steps of:

providing a supply of solid-state copper in a copper generation tank;

adding sulfuric acid and hydrogen peroxide to the copper generation tank for generating a plating solution from the copper supply;

maintaining a copper sulfate concentration of about 35 ounces per gallon to about 65 ounces per gallon in the plating solution in the plating tank;

circulating depleted plating solution back to the copper generation tank as the workpiece is electroplated in the plating tank;

returning the plating solution with increased copper sulfate concentration from the copper generation tank into the plating tank; and maintaining the hydrogen peroxide at a concentration of about 0.0045 ounces per gallon or less in the plating solution in the plating tank.

8. A process for electrolytically depositing copper onto a workpiece utilizing an electroplating apparatus including a power source, a generation vessel, and a plating vessel, said process comprising the steps of:

generating a plating solution of $CuSO_4$ by adding solid-state copper and $H_2SO_4$ and $H_2O_2$ to the generation vessel;

allowing the solution to flow to the plating vessel;

providing an insoluble, dimensionally stable anode in the plating vessel in contact with the solution;

immersing the workpiece in the solution in the plating vessel;

passing an electric current through the solution between the anode and the workpiece to be plated so that the workpiece acts as a cathode in an electrolytic circuit and copper ions are electrolytically deposited as copper onto the workpiece; and continuously circulating the solution between the generation vessel and the plating vessel by circulating the solution from the generation vessel through a holding vessel to the plating vessel, where the copper is deposited on the workpiece, and returning $CuSO_4$ depleted solution via the holding vessel to the generation vessel in order to replenish $CuSO_4$ in the solution, said holding vessel allowing $CuSO_4$ depleted solution from the plating vessel to commingle with $CuSO_4$ replenished solution from the generation vessel.

* * * * *

UNITED STATES PATENT AND TRADEMARK OFFICE

CERTIFICATE OF CORRECTION

PATENT NO. : 6,527,934 B1
DATED : March 4, 2003
INVENTOR(S) : Steward, Michael A.

It is certified that error appears in the above-identified patent and that said Letters Patent is hereby corrected as shown below:

Title page,
Item [75], change, "Inventor" to -- Inventors --, and add the following inventor:
-- Laurens Willard, Charlotte, NC (US) --.

Signed and Sealed this

Twenty-second Day of July, 2003

JAMES E. ROGAN
*Director of the United States Patent and Trademark Office*